US011053693B2

(12) United States Patent
De Rick

(10) Patent No.: US 11,053,693 B2
(45) Date of Patent: Jul. 6, 2021

(54) PLURALITY OF FLOOR PANELS AND FLOOR PANELS USED HEREBY

(71) Applicant: FLOORING INDUSTRIES LIMITED, SARL, Bertrange (LU)

(72) Inventor: Jan Eddy De Rick, Geraardsbergen (BE)

(73) Assignee: FLOORING INDUSTRIES LIMITED, SARL, Bertrange (LU)

( * ) Notice: Subject to any disclaimer, the term of this patent is extended or adjusted under 35 U.S.C. 154(b) by 0 days.

(21) Appl. No.: 16/756,242

(22) PCT Filed: Oct. 26, 2018

(86) PCT No.: PCT/IB2018/058374
§ 371 (c)(1),
(2) Date: Apr. 15, 2020

(87) PCT Pub. No.: WO2019/082141
PCT Pub. Date: May 2, 2019

(65) Prior Publication Data

US 2020/0318360 A1 Oct. 8, 2020

Related U.S. Application Data

(60) Provisional application No. 62/577,547, filed on Oct. 26, 2017.

(51) Int. Cl.
*E04B 2/00* (2006.01)
*E04F 15/02* (2006.01)

(52) U.S. Cl.
CPC ..... *E04F 15/02038* (2013.01); *E04F 2201/0138* (2013.01); *E04F 2201/0153* (2013.01); *E04F 2201/023* (2013.01); *E04F 2201/042* (2013.01); *E04F 2201/043* (2013.01)

(58) Field of Classification Search
CPC ..... E04F 15/02038; E04F 2201/0552; E04F 2201/023; E04F 2201/0535; E04F 2201/0146; E04F 2201/2201; E04F 2201/043; E04F 2201/0547;
(Continued)

(56) References Cited

U.S. PATENT DOCUMENTS

| | | | | |
|---|---|---|---|---|
| 4,426,820 | A | 1/1984 | Terbrack et al. | |
| 10,612,250 | B2 * | 4/2020 | De Rick | E04F 13/0889 |
| 10,648,182 | B2 * | 5/2020 | De Rick | E04F 15/02038 |

(Continued)

FOREIGN PATENT DOCUMENTS

| | | | |
|---|---|---|---|
| WO | 9747834 | A1 | 12/1997 |
| WO | 2017115202 | A1 | 7/2017 |

OTHER PUBLICATIONS

International Search Report and Written Opinion from PCT Application No. PCT/IB2018/058374 dated Feb. 13, 2019.

*Primary Examiner* — Chi Q Nguyen
(74) *Attorney, Agent, or Firm* — Workman Nydegger

(57) ABSTRACT

A plurality of floor panels consists of a first series of floor panels includes first floor panels, and a second series of floor panels includes second floor panels. The first and second floor panels are configured for fold-type coupling. The first and second floor panels define coupling parts mutually differing from each other and are configured so that the first and second floor panels are compatible and able to be coupled to one another.

9 Claims, 5 Drawing Sheets

(58) Field of Classification Search
CPC ..... E04F 2201/0153; E04F 2201/0138; E04F 2201/042
USPC ..... 52/592.1, 592.2, 592.3, 588.1
See application file for complete search history.

(56) References Cited

U.S. PATENT DOCUMENTS

| | | | | |
|---|---|---|---|---|
| 10,683,668 | B2 * | 6/2020 | De Rick | E04F 15/107 |
| 10,815,677 | B2 * | 10/2020 | De Rick | E04F 15/107 |
| 2009/0249733 | A1 * | 10/2009 | Moebus | E04F 15/04 52/588.1 |
| 2012/0180416 | A1 * | 7/2012 | Perra | E04F 15/02 52/309.1 |
| 2018/0094441 | A1 * | 4/2018 | Boo | E04F 15/105 |

* cited by examiner

PLURALITY OF FLOOR PANELS AND FLOOR PANELS USED HEREBY

This application claims the benefit under 35 U.S.C. 119(e) to the U.S. provisional applications U.S. 62/577,547 filed on Oct. 26, 2017.

BACKGROUND OF THE INVENTION

Field of the Invention

This invention relates to a plurality of floor panels and to floor panels which are used hereby.

More particularly it relates to a plurality of floor panels, consisting of a first series of floor panels, herein below named first floor panels, and a second series of floor panels, herein below named second floor panels, wherein the first floor panels show the following characteristics:

- the floor panel comprises a first pair of opposite edges as well as a second pair of opposite edges;
- the first pair of opposite edges comprises coupling parts which allow that two of such floor panels mutually can be coupled to each other, wherein these coupling parts show the following characteristics:
  - the coupling parts comprise a horizontally active locking system, which, in a coupled condition of two of such floor panels, effects a locking in the plane of the floor panels and perpendicular to the respective edges;
  - the coupling parts also comprise a vertically active locking system, which, in a coupled condition of two of such floor panels, effects a locking transverse to the plane of the floor panels;
  - the coupling parts are realized substantially from the material of the floor panel itself; and
  - the coupling parts are configured such that two of such panels can be coupled to each other at these edges by means of a turning movement;
- the second pair of opposite edges also comprises coupling parts at both edges which allow that two of such floor panels mutually can be coupled to each other, wherein these coupling parts show the following characteristics:
  - the coupling parts comprise a horizontally active locking system, which, in a coupled condition of two of such floor panels, effects a locking in the plane of the floor panels and perpendicular to the respective edges;
  - the coupling parts also comprise a vertically active locking system, which, in a coupled condition of two of such floor panels, effects a locking transverse to the plane of the floor panels;
  - the coupling parts are realized substantially from the material of the floor panel itself;
  - the horizontally active locking system of the second pair of edges is at least formed of an upward-directed lower hook-shaped part which is situated on one of said two edges, as well as a downward-directed upper hook-shaped part which is situated at the opposite edge, wherein the lower hook-shaped part consists of a lip with an upward-directed locking element, which, proximally thereto, defines a female part in the form of a recess, whereas the upper hook-shaped part consists of a lip with a downward-directed locking element which forms a male part;
  - the coupling parts are configured such that two of such floor panels can be coupled to each other at their respective edges by means of a downward movement of the one floor panel in respect to the other;
  - the vertically active locking system comprises vertically active locking parts, which, by means of respective contact surfaces, define at least a first contact zone and a second contact zone which are situated on opposite sides of the male part and female part;
  - for this purpose, the aforementioned vertically active locking parts comprise a first locking part and a second locking part at the respective opposite sides of the male part, as well as a third locking part and a fourth locking part at the respective opposite sides of the female part;
  - the first and third locking part, in the coupled condition of two of such floor panels, define the aforementioned first contact zone, wherein they have contact surfaces, which, in the coupled condition, define at least one inclined tangent line;
  - the second and fourth locking part, in the coupled condition of two of such floor panels, define the aforementioned second contact zone, wherein they have contact surfaces, which, in the coupled condition, also define at least one inclined tangent line;
  - the aforementioned male part has a distal side and a proximal side, wherein the second locking part is situated at the distal side;
  - the aforementioned two tangent lines are upwardly inclined towards each other, from their respective contact zones, by which is meant that both tangent lines, from their respective contact zone, are upwardly, and in respect to the recess of the female part inwardly, inclined and thus the tangent lines, upwardly and in respect to a vertical, are inclined in opposite directions;

and wherein the second floor panels show the following characteristics:

- the floor panel comprises a first pair of opposite edges as well as a second pair of opposite edges;
- the first pair of opposite edges comprises coupling parts which allow that two of such floor panels mutually can be coupled to each other, wherein these coupling parts show the following characteristics:
  - the coupling parts comprise a horizontally active locking system, which, in a coupled condition of two of such floor panels, effects a locking in the plane of the floor panels and perpendicular to the respective edges;
  - the coupling parts also comprise a vertically active locking system, which, in a coupled condition of two of such floor panels, effects a locking transverse to the plane of the floor panels;
  - the coupling parts are realized substantially from the material of the floor panel itself; and
  - the coupling parts are configured such that two of such panels can be coupled to each other at these edges by means of a turning movement;
- the second pair of opposite edges also comprises coupling parts at both edges, which allow that two of such floor panels mutually can be coupled to each other, wherein these coupling parts show the following characteristics:
  - the coupling parts comprise a horizontally active locking system, which, in a coupled condition of two of such floor panels, effects a locking in the plane of the floor panels and perpendicular to the respective edges;

the coupling parts also comprise a vertically active locking system, which, in a coupled condition of two of such floor panels, effects a locking transverse to the plane of the floor panels;

the coupling parts are realized substantially from the material of the floor panel itself;

the horizontally active locking system of the second pair of edges is at least formed of an upward-directed lower hook-shaped part which is situated at one of the aforementioned two edges, as well as a downward-directed upper hook-shaped part which is situated at the opposite edge, wherein the lower hook-shaped part consists of a lip with an upward-directed locking element that proximally thereof defines a female part in the form of a recess, whereas the upper hook-shaped part consists of a lip with a downward-directed locking element which forms a male part;

the coupling parts are configured such that two of such floor panels can be coupled to each other at their respective edges by means of a downward movement of the one floor panel in respect to the other;

the vertically active locking system comprises vertically active locking parts which, by means of respective contact surfaces, define at least a first contact zone and a second contact zone;

the aforementioned male part has a distal side and a proximal side;

the aforementioned lower hook-shaped element has a distal end;

the aforementioned vertically active locking parts comprise a first locking part and a second locking part at the edge which is provided with the aforementioned male part, as well as a third locking part and a fourth locking part at the edge which is provided with the aforementioned female part;

the first and third locking part, in the coupled condition of two of such floor panels, define the first contact zone, wherein the first locking part is situated at the proximal side of the aforementioned male part, whereas the third locking part is situated at an opposed side of the female part of the floor panel coupled thereto;

the second and fourth locking part, in the coupled condition of two of such floor panels, define the second contact zone, wherein the fourth locking part is situated at the aforementioned distal end of the lower hook-shaped element, whereas the second locking part is situated at the opposed side of the floor panel coupled thereto.

From the characteristics of the floor panels it is clear that, for the "first floor panels" as well as for the "second floor panels", this relates to floor panels of the type which allows performing an installation by means of the fold-down principle. This means that the floor panels can be coupled to each other at the first pair of edges by means of a turning movement, while simultaneous to this turning movement at the first pair of edges also a coupling at the second pair of edges is realized by means of a, seen in cross-section, downward movement.

SUMMARY OF THE DISCLOSURE

The particularity of the invention consists in that the first floor panels and second floor panels are compatible, by which is meant that they, anyhow at least at certain edges thereof, can be coupled to each other. More particularly are the floor panels characterized in that the coupling means, more particularly coupling parts, of the first pair of edges of the first floor panels and the coupling means, more particularly coupling parts, of the first pair of edges of the second floor panels are compatible with each other, as well as the coupling means, more particularly coupling parts, of the second pair of edges of the first floor panels and the coupling means, more particularly coupling parts, of the second pair of edges of the second floor panels are compatible with each other, such that, when a first floor panel and a second floor panel are coupled to each other, via edges of their first pair of edges, a horizontal as well as a vertical locking is maintained, as well as such that, when a first floor panel and a second floor panel are coupled to each other, via edges of their second pair of edges, also a horizontal as well as a vertical locking is maintained.

The inventor has found that the coupling parts of the herein above-defined "first floor panels" and coupling parts of the herein above-defined "second floor panels" can be realized compatible, at least in certain respects, with the advantage that first floor panels can be coupled to previously installed second floor panels and/or second floor panels can be coupled to previously installed first floor panels and/or first and second floor panels can be used in a mixed manner in one and the same floor covering. This offers the advantage that a manufacturer of floor panels can switch from one coupling system to another without problems, by which a freedom is created by which he has the possibility to perform such switching in function of technical and/or economical causes. Preferably, herein it is the intention that the manufacturer, in respect to decorative appearance or surface of the panels, can proceed with the same range of products, while the coupling parts are altered. Due to the compatibility of the floor panels the commercialization simply can continue without the installing person having to take care that the first and second floor panels are used in one and the same floor covering, as this, thanks to the invention, does not pose a problem.

The aforementioned compatibility can be effective in one direction as well as in two directions, as will be elucidated herein below.

It is noted that the invention in general relates to floor panels for forming a floor covering, and more particularly for forming a decorative floor surface. More particularly, this also relates to floor panels which can be installed floatingly. According to the invention, this can relate to floor panels of any material or of any composition. Some practical examples are laminate floor panels; floor panels with a wood-based substrate, such as an MDF of HDF board; "engineered wood" panels; synthetic material-based floor panels, such as bendable or rigid so-called LVT; floor panels with a substrate of another material than wood or synthetic material; or floor panels which are composed of a plurality of material layers, such as floor panels with a substrate, whether or not synthetic material-based and whether or not foamed or provided with fillers, on which a decorative top layer of another material is provided, for example of wood, stone, synthetic material, such as a vinyl layer.

The floor panels can be realized in any appropriate thicknesses. In practice, these thicknesses may vary between 2 and 15 mm.

The invention also relates to floor panels as such, wherein this then may relate to the "first floor panels" if those, at least at one or more edges, and preferably all respective edges, are realized compatible with "second floor panels" which already are or were available on the market. Vice versa, this may also relate to "second floor panels" if these, at least at one or more edges, and preferably all respective edges, are realized compatible with "first floor panels" which already are or were available on the market.

Further characteristics shall become clear from the description, claims and drawings following herein below.

BRIEF DESCRIPTION OF THE DRAWINGS

With the intention of better showing the characteristics of the invention, herein below, as an example without any limitative character, some preferred embodiments are described, with reference to the accompanying drawings, wherein.

DETAILED DESCRIPTION OF PREFERRED EMBODIMENTS OF THE INVENTION

Figure 1:
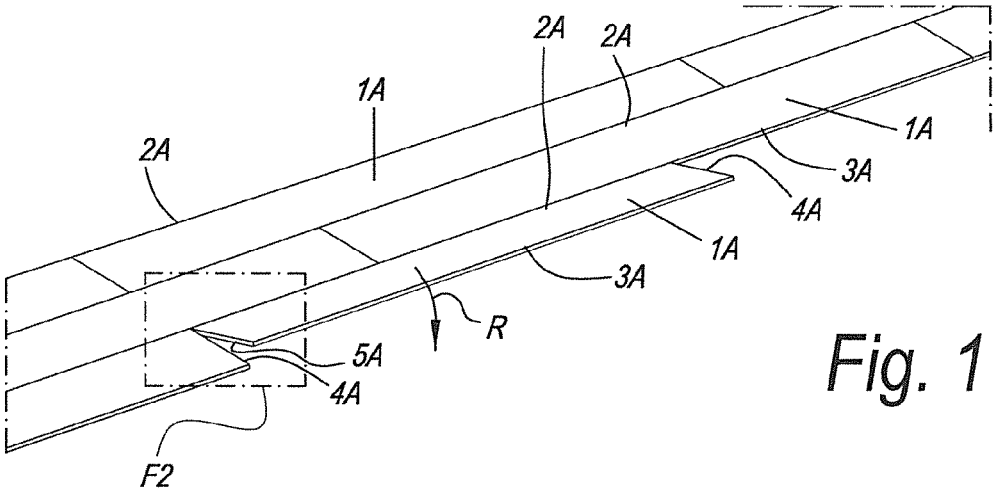
FIG. 1 schematically represents a floor covering of floor panels which are installed according to the fold-down principle.
Figure 2:
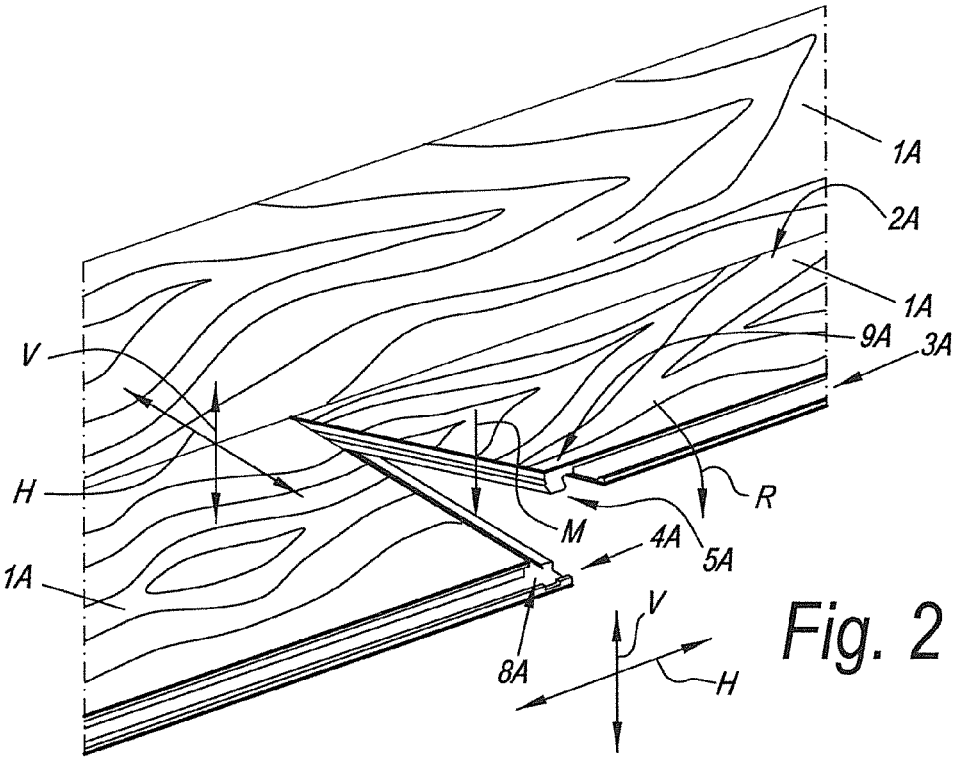
FIG. 2, at a larger scale, represents the part which in FIG. 1 is indicated by F2 for a floor covering of "first" floor panels of the invention.
Figure 3:
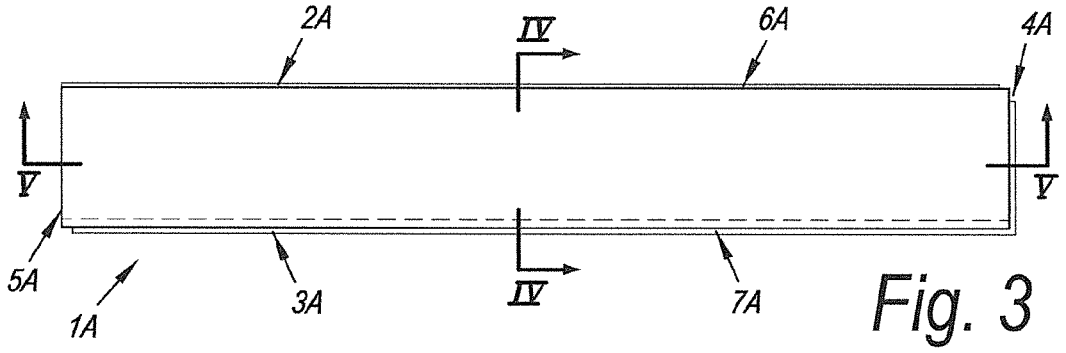
FIGS. 3 to 5 represent different views of an embodiment of a "first" floor panel.

In FIGS. 1 and 2 is represented how "first" floor panels 1A can be installed via the fold-down technique. This fold-down technique is known as such and also is valid for interconnecting "second" floor panels, as well as for compatibly installing and mutually connecting of, according to the invention, mixed use of first and second floor panels 1A and 1B. FIG. 2 moreover clearly illustrates by means of the indicated turning movement R and downward movement M how is proceeded with such fold-down technique.

The composition and manner of mutually coupling of the first floor panels 1A are represented in FIGS. 3 to 6.

Herein, the first floor panels 1A show at least the following characteristics:

- the floor panel 1A comprises a first pair of opposite edges 2A-3A as well as a second pair of opposite edges 4A-5A;
- the first pair of opposite edges 2A-3A comprises coupling parts 6A-7A which allow that two of such floor panels 1A mutually can be coupled to each other, wherein these coupling parts 6A-7A show the following characteristics:
  - the coupling parts 6A-7A comprise a horizontally active locking system, which, in a coupled condition of two of such floor panels 1A, effects a locking in the plane of the floor panels 1A and perpendicular to the respective edges 2A-3A;
  - the coupling parts 6A-7A also comprise a vertically active locking system, which, in a coupled condition of two of such floor panels 1A, effects a locking transverse to the plane of the floor panels;
  - the coupling parts 6A-7A are realized substantially from the material of the floor panel 1A itself; and
  - the coupling parts 6A-7A are configured such that two of such panels 1A can be coupled to each other at these edges by means of a turning movement R;
- the second pair of opposite edges 4A-5A also comprises coupling parts 8A-9A at both edges which allow that two of such floor panels 1A mutually can be coupled to each other, wherein these coupling parts 8A-9A show the following characteristics:
  - the coupling parts 8A-9A comprise a horizontally active locking system, which, in a coupled condition of two of such floor panels 1A, effects a locking in the plane of the floor panels 1A and perpendicular to the respective edges 4A-5A;
  - the coupling parts 8A-9A also comprise a vertically active locking system, which, in a coupled condition of two of such floor panels 1A, effects a locking transverse to the plane of the floor panels 1A;
  - the coupling parts 8A-9A are realized substantially from the material of the floor panel 1A itself;
  - the horizontally active locking system of the second pair of edges 4A-5A is at least formed of an upward-directed lower hook-shaped part 10A which is situated on one of said two edges, in this case edge 4A, as well as a downward-directed upper hook-shaped part 11A which is situated at the opposite edge 5A, wherein the lower hook-shaped part 10A consists of a lip 12A with an upward-directed locking element 13A, which, proximally thereto, defines a female part 14A in the form of a recess, whereas the upper hook-shaped part 11A consists of a lip 15A with a downward-directed locking element 16A which forms a male part 17A;
  - the coupling parts 8A-9A are configured such that two of such floor panels 1A can be coupled to each other at their respective edges 4A-5A by means of a downward movement M of the one floor panel in respect to the other;
  - the vertically active locking system comprises vertically active locking parts 18A-19A-20A-21A, which, by means of respective contact surfaces 22A-23A-24A-25A, define at least a first contact zone C1A and a second contact zone C2A, which are situated on opposite sides of the male part 17A and female part 14A;
  - for this purpose, the aforementioned vertically active locking parts comprise a first locking part 18A and a second locking part 19A at the respective opposite sides 26A-27A of the male part 17A, as well as a third locking part 20A and a fourth locking part 21A at the respective opposite sides 28A-29A of the female part 14A;
  - the first locking part 18*a* and the third locking part 20A, in the coupled condition of two of such floor panels 1A, define the aforementioned first contact zone C1A, wherein they have contact surfaces 22A, 24A, respectively, which, in the coupled condition, define at least one inclined tangent line T1;
  - the second locking part 19A and the fourth locking part 21A, in the coupled condition of two of such floor panels 1A, define the aforementioned second contact zone C2A, wherein they have contact surfaces 23A, 25A, respectively, which, in the coupled condition, also define at least one inclined tangent line T2;
  - the aforementioned male part 17A has a distal side 27A and a proximal side 26A, wherein the second locking part 19A is situated at the distal side 27A;

the aforementioned two tangent lines T1-T2 are upwardly inclined towards each other, from their respective contact zones C1A-C2A, by which is meant that both tangent lines, from their respective contact zone, are upwardly, and in respect to the recess of the female part inwardly, inclined and thus the tangent lines, upwardly and in respect to a vertical, are inclined in opposite directions.

The composition and the manner of mutual coupling of the second floor panels 1B are represented in FIGS. 7 to 10.

Herein, the second floor panels 1B show at least the following characteristics:

the floor panel 1B comprises a first pair of opposite edges 2B-3B as well as a second pair of opposite edges 4B-5B;

the first pair of opposite edges 2B-3B comprises coupling parts 6B-7B which allow that two of such floor panels 1B mutually can be coupled to each other, wherein these coupling parts 6B-7B show the following characteristics:

the coupling parts 6B-7B comprise a horizontally active locking system, which, in a coupled condition of two of such floor panels 1B, effects a locking in the plane of the floor panels 1B and perpendicular to the respective edges 2B-3B;

the coupling parts 6B-7B also comprise a vertically active locking system, which, in a coupled condition of two of such floor panels 1B, effects a locking transverse to the plane of the floor panels;

the coupling parts 6B-7B are realized substantially from the material of the floor panel 1B itself; and the coupling parts 6B-7B are configured such that two of such panels 1B can be coupled to each other at these edges by means of a turning movement R;

the second pair of opposite edges 4B-5B also comprises coupling parts 8B-9B at both edges, which allow that two of such floor panels 1B mutually can be coupled to each other, wherein these coupling parts 8B-9B show the following characteristics:

the coupling parts 8B-9B comprise a horizontally active locking system, which, in a coupled condition of two of such floor panels 1B, effects a locking in the plane of the floor panels 1B and perpendicular to the respective edges 4B-5B;

the coupling parts 8B-9B also comprise a vertically active locking system, which, in a coupled condition of two of such floor panels 1B, effects a locking transverse to the plane of the floor panels 1B;

the coupling parts 8B-9B are realized substantially from the material of the floor panel 1B itself;

the horizontally active locking system of the second pair of edges 4B-5B is at least formed of an upward-directed lower hook-shaped part 10B which is situated at one of the aforementioned two edges, in this case edge 4B, as well as a downward-directed upper hook-shaped part 11B which is situated at the opposite edge 5B, wherein the lower hook-shaped part 10B consists of a lip 12B with an upward-directed locking element 13B that proximally thereof defines a female part 14B in the form of a recess, whereas the upper hook-shaped part 11B consists of a lip 15B with a downward-directed locking element 16B which forms a male part 17B;

the coupling parts 8B-9B are configured such that two of such floor panels 1B can be coupled to each other at their respective edges 4B-5B by means of a downward movement M of the one floor panel in respect to the other;

the vertically active locking system comprises vertically active locking parts 18B-30B-20B-31B, which, by means of respective contact surfaces 22B-32B-24B-33B, define at least a first contact zone C1B and a second contact zone C2B;

the aforementioned male part has a distal side 27B and a proximal side 26B;

the aforementioned lower hook-shaped element has a distal end 34B;

the aforementioned vertically active locking parts comprise a first locking part 18B and a second locking part 30B at the edge which is provided with the aforementioned male part 17B, as well as a third locking part 20B and a fourth locking part 31B at the edge which is provided with the aforementioned female part;

the first and third locking part, in the coupled condition of two of such floor panels, define the first contact zone C1B, wherein the first locking part 18B is situated at the proximal side 26B of the aforementioned male part 17B, whereas the third locking part 20B is situated at an opposed side of the female part of the floor panel coupled thereto, wherein by an "opposed side" the "cooperating" or "corresponding" side is meant;

the second and fourth locking part, in the coupled condition of two of such floor panels 1B, define the second contact zone C2B, wherein the fourth locking part is situated at the aforementioned distal end of the lower hook-shaped element, whereas the second locking part 31B is situated at the opposed side 35B of the floor panel coupled thereto.

The invention, more particularly the "plurality of floor panels" according to the invention, is characterized in that the coupling means, more particularly coupling parts 6A-7A, of the first pair of edges 2A-3A of the first floor panels 1A and the coupling means, more particularly coupling parts 6B-7B, of the first pair of edges 2B-3B of the second floor panels 1B are compatible with each other, as well as the coupling means, more particularly coupling parts 8A-9A, of the second pair of edges 4A-5A of the first floor panels 1A and the coupling means, more particularly coupling parts 8B-9B, of the second pair of edges 4B-5B of the second floor panels 1B are compatible with each other, such that, when a first floor panel 1A and a second floor panel 1B are coupled to each other, via edges of their first pair of edges, a horizontal as well as a vertical locking is maintained, as well as such that, when a first floor panel 1A and a second floor panel 1B are coupled to each other, via edges of their second pair of edges, also a horizontal as well as a vertical locking is maintained.

Figure 4:
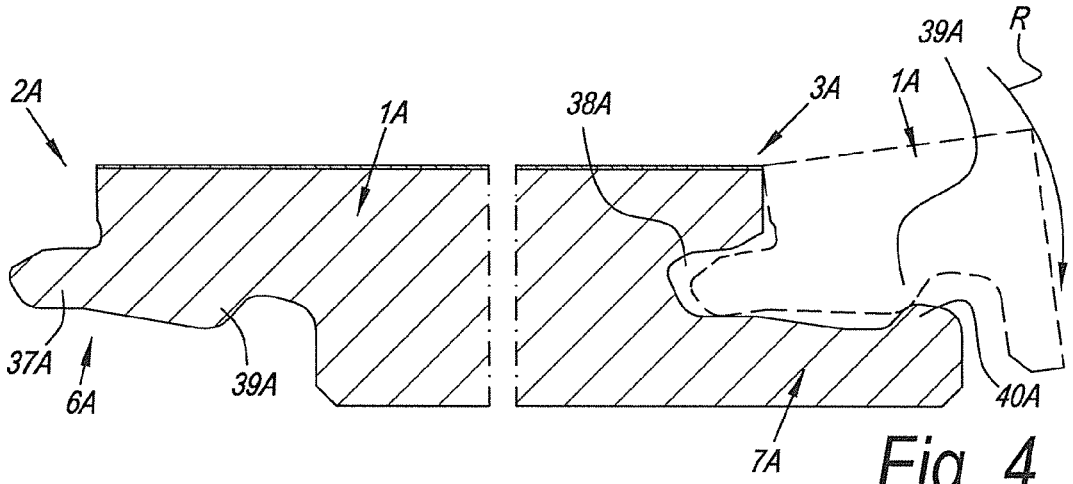
Figure 5:
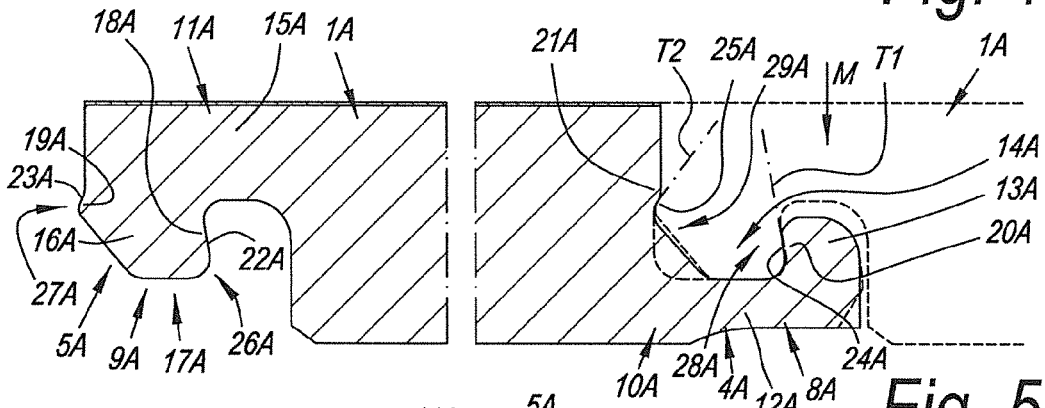
Figure 6:
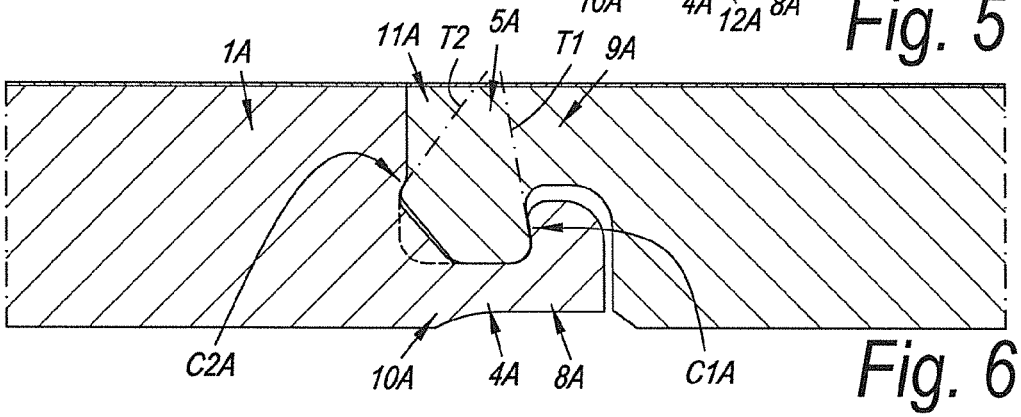
FIG. 6 represents two first floor panels coupled at their second pair of edges.
Figure 7:
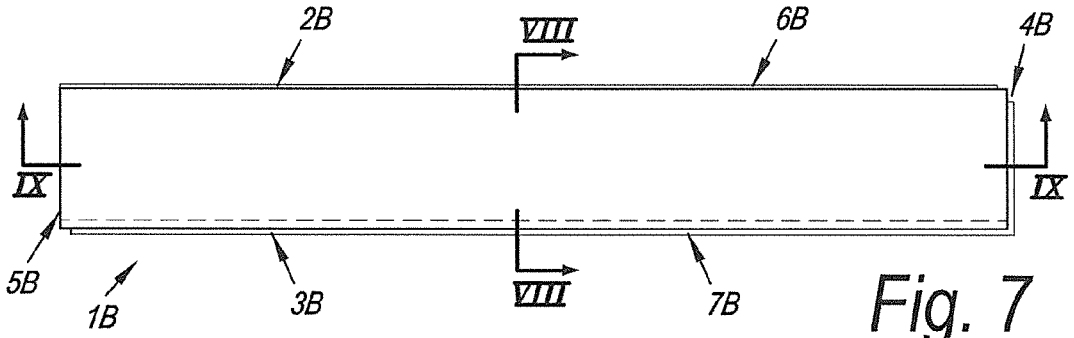
FIGS. 7 to 9 represent different views of an embodiment of a "second" floor panel.
Figure 8:
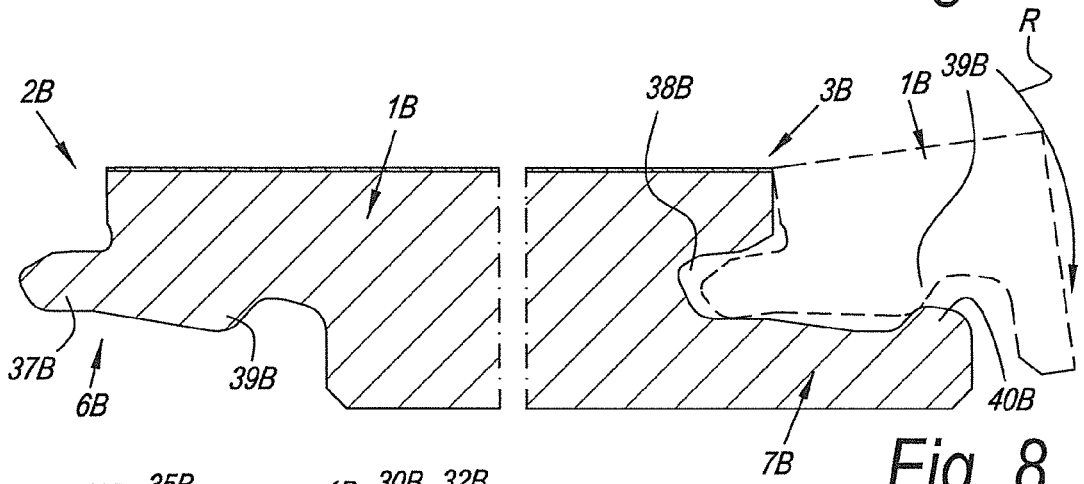
Figure 9:
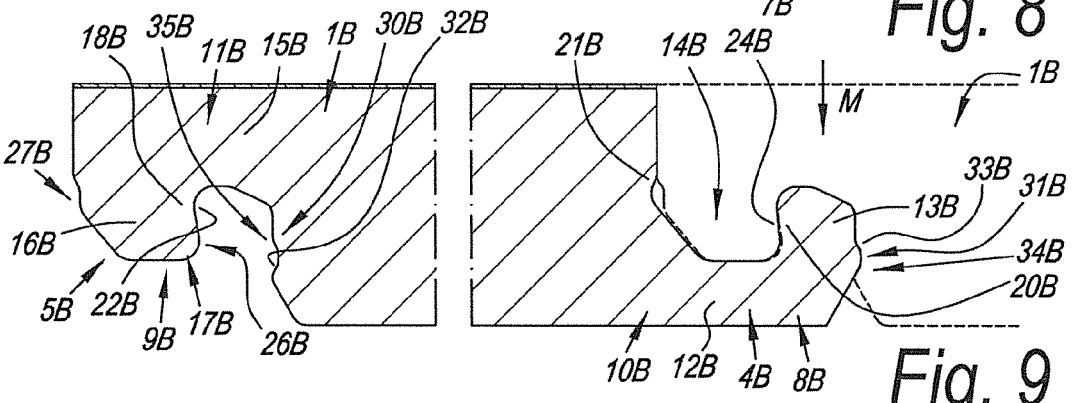
Figure 10:
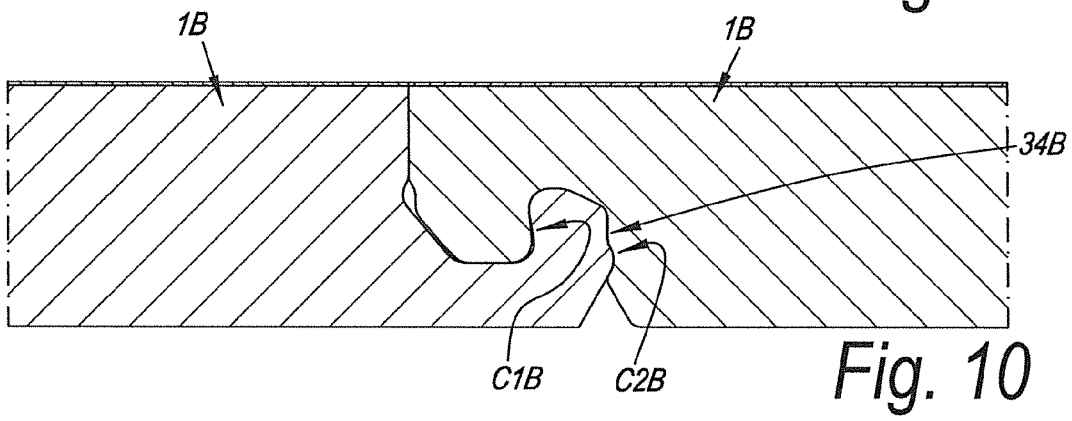
FIG. 10 represent two second floor panels coupled at their second pair of edges.

As can be observed in FIGS. 4 and 8, the coupling parts at the first pair of edges 2A-3A of the first floor panel 1A and the first pair of edges 2B-3B of the second floor panel 2B are compatible in that they are realized identically. It is noted that here, also, compatible coupling parts can be used, which in respect to design differ from each other, in other words that the coupling parts of the "first" floor panels and the "second" floor panels have a shape differing from each other, however, still fit into each other in a locking manner.

It is also noted that the coupling parts in FIGS. 4 and 8 are formed of so-called "Uniclic" profiles, known, amongst others, from WO 97/47834. However, any coupling profile can be applied, so, for example, also the so-called 2G profile developed by the Valinge company, as well as a profile which in the meantime is widely known in the sector, of which the underside of the tongue is convex, for example approximately semicircular, whereas the recess in the longer lower lip then is concave. This last-mentioned profile form, as well as other applicable profile forms, are known from U.S. Pat. No. 4,426,820.

Figure 11:
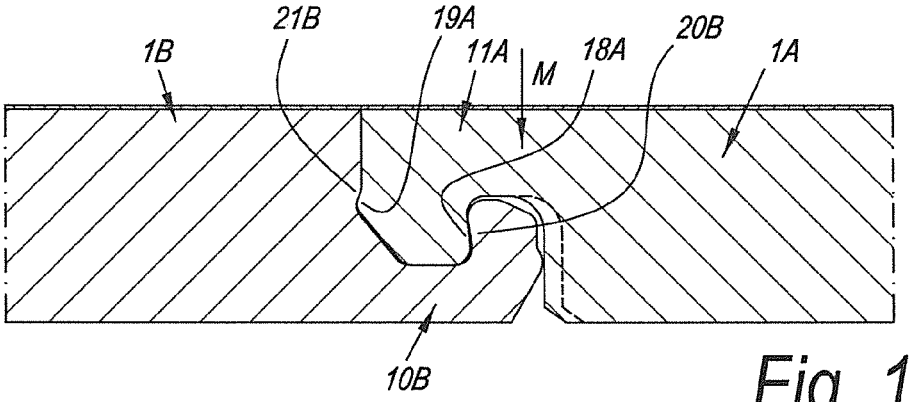
FIGS. 11 and 12 represent how the first and second floor panels can be coupled to each other at their second pair of edges in a compatible manner.
Figure 12:
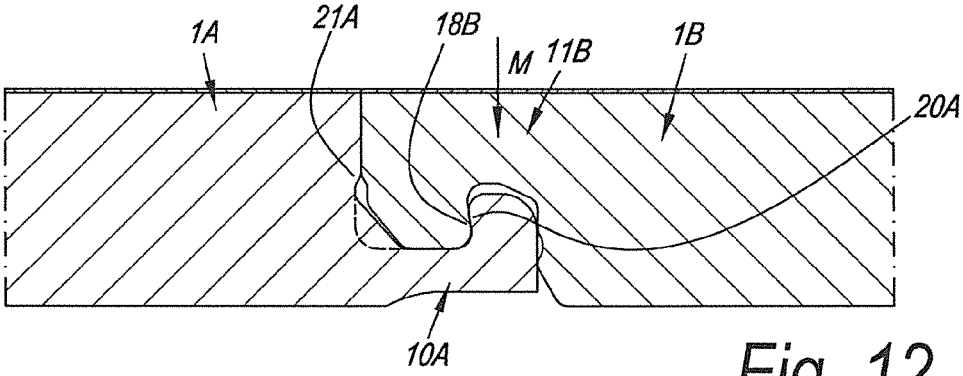

FIGS. 11 and 12 illustrate how the hook-shaped parts of the second pairs of edges of the first floor panel 1A and the second floor panel 1B are compatible with each other and thus fit into each other and thereby maintain offering a mechanical locking in horizontal direction as well as in vertical direction.

It is noted that the horizontal and/or vertical locking effect between two different floor panels, thus, a "first" and a "second" floor panel, does not necessarily have to be the same, in other words, has to be realized with the same strength as the locking effect that is obtained between two of the same floor panels.

FIG. 11 shows how the upper hook-shaped part 11A of a "first" floor panel 1A fits into the lower hook-shaped part 10B of a "second" floor panel 1B, whereas FIG. 12 then shows how the upper hook-shaped part 11B of the "second" floor panel 1B fits into the lower hook-shaped part 10A of the "first" floor panel 1A. In this case, thus, there is a compatibility in both directions, however, according to a not-represented variant of the invention such compatibility can also be effective in only one direction.

The parts indicated in dashed line in FIGS. 5, 6, 11 and 12 indicate variants, such to illustrate that one is not bound to fixed shapes for the coupling parts.

In FIG. 11, at the distal end of the lower hook-shaped element, a clamping, represented in solid line, or a space, represented in dashed line, can be provided.

In the embodiment and application of FIG. 11, the vertical locking is obtained by the cooperation of the locking parts 18A and 20B, as well as by the cooperation of the locking part 19A with a locking part 21B provided at the floor panel 1B.

In the embodiment and application of FIG. 12, the vertical locking is obtained by the cooperation of the locking parts 20A and 18B. The locking part 21A then is inactive.

Figure 13:
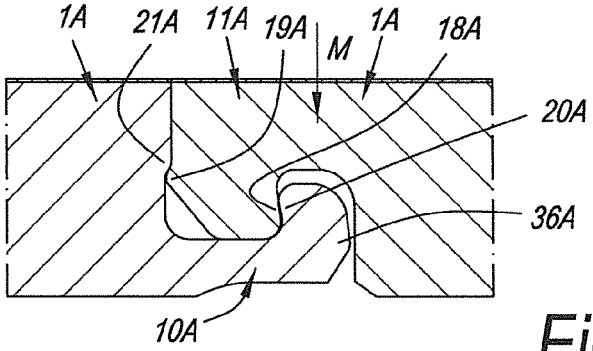
FIGS. 13 and 14 further relate to a variant.
Figure 14:
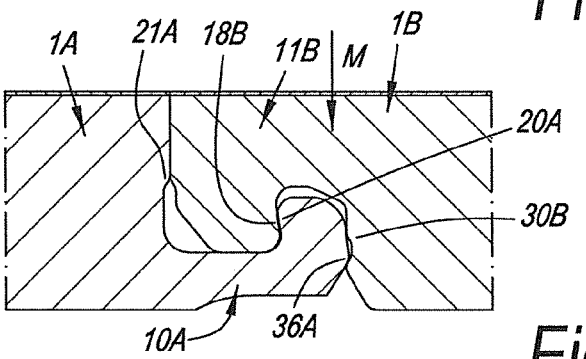

In FIGS. 13 and 14, another variant is represented. FIG. 13 represents first floor panels 1A which are coupled at the respective edges. The floor panel 1A comprises a part 36A, which, when coupled with floor panel 1B, such as represented in FIG. 14, at least partially cooperates with locking part 30B in order to provide for an extra locking. This thus means that in the coupled condition of FIG. 14 a vertical locking as a result of the cooperating locking parts 20A and 18B is present, as well as a result of the cooperation of the locking parts 36A and 30B.

It is clear that the first and second floor panels in mutually coupled condition preferably at their upper surface adjoin each other in a normal manner, whether or not with the intermediary of a chamfer or the like.

It is also clear that by the contact zones C1A, C2A, C1B and C2B vertically locking zones are meant, wherein thus to a lesser or greater extent a vertical mechanical locking is realized, such by parts engaging behind each other. Herein, a pure friction or clamping without undercut per definition does not form a "mechanical" locking.

It is clear that in the contact zones C1A and C1B undercuts, even if to a small extent, exist indeed, and that these thus in fact form mechanical vertical lockings.

It is noted that the invention, amongst others, as such consists in that in the specifically defined floor panels, thus the floor panels with the claimed coupling parts, it has been thought of making them compatible while maintaining certain lockings. However, it is clear that this inventive idea can be realized with a broad range of designs of coupling parts, by which a functional definition, by stating that the coupling parts are "compatible", thus also is justified.

It is noted that preferably at the locations where contact zone C1A and contact zone C1B are present always a vertically active locking is present when a coupling between floor panels 1A and 1B is realized.

According to a deviating alternative embodiment of the invention, the floor panels 1A and 1B can be realized such that at the location of C1A and C1B no vertical lockings exist and for example only vertical contacts exist.

According to another deviating alternative it is not excluded to indeed provide in a horizontal locking at the edges 4 and 5, however, omitting the vertical locking when a first and second floor panel are coupled to each other.

From FIG. 4, it is clear that the coupling parts 6A and 7A preferably consist of a horizontally locking tongue and groove connection. The tongue 37A and the groove 38A provide for the vertical locking, while locking parts 39A and 40A provided thereon provide for that a horizontal locking is obtained, such in that the locking part 39A in the coupled condition engages behind the locking part 40A and in this manner, seen in cross-section, prevents or at least counteracts the shifting apart of the tongue 37A and the groove 38A.

In an analogous manner, it is clear from FIG. 8 that the coupling parts 6B and 7B preferably consist of a horizontally locking tongue and groove connection. The tongue 37B and the groove 38B provide for the vertical locking, while locking parts 39B and 40B provided thereon provide for that a horizontal locking is obtained, such in that the locking part 39B in the coupled condition engages behind the locking part 40B and in this manner, seen in cross-section, prevents or at least counteracts the shifting apart of the tongue 37B and the groove 38B.

As becomes clear from FIGS. 1, 2, 3 and 7, the invention is intended in particular for being employed with oblong floor panels 1A-1B, thus, floor panels with long sides and short sides, wherein the first pair of opposite edges then preferably forms the long sides and the second pair of opposite edges then forms the short sides. Therein, the floor panels are configured such that they can be installed by means of the fold-down principle.

However, the preceding does not exclude that the invention can also be applied with square panels.

Figure 15:
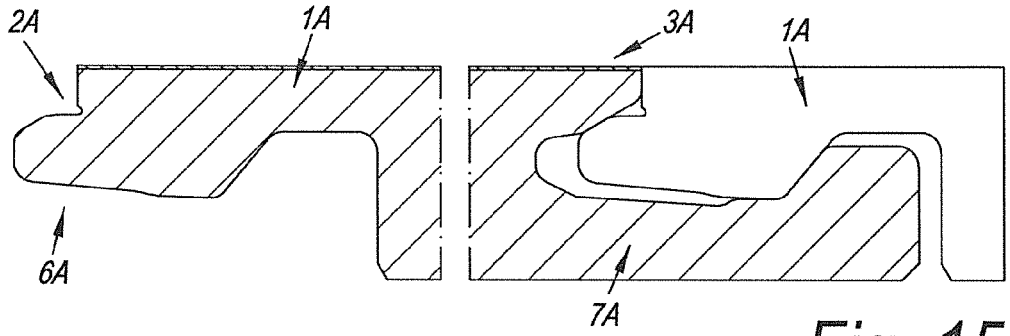
FIGS. 15 to 18 relate to another variant.
Figure 16:
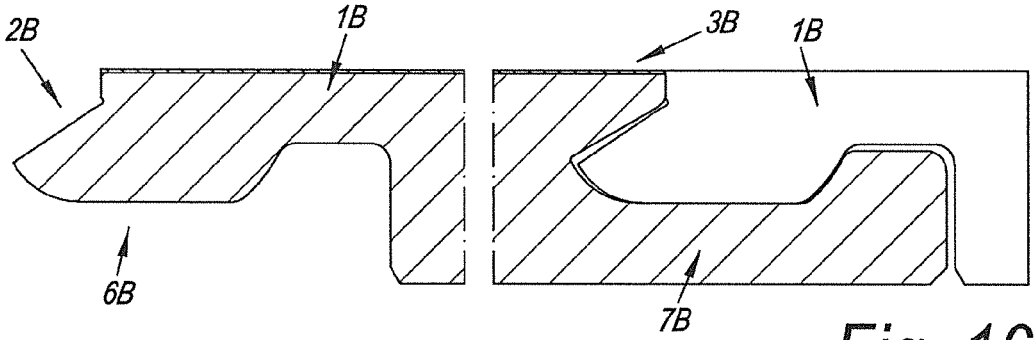
Figure 17:
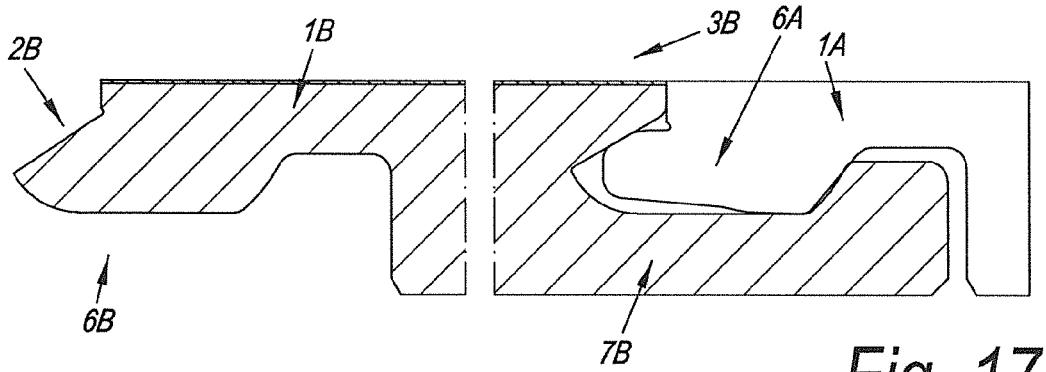
Figure 18:
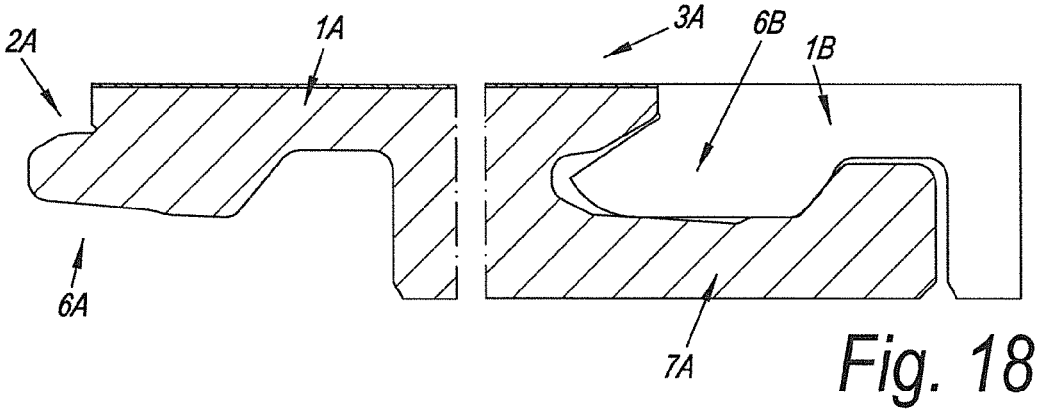

FIGS. 15 to 18 represent another embodiment of two floor panels 1A and 1B, which, at their first pair of opposite edges, comprise compatible coupling parts 6A-7A and 6B-7B, which coupling parts now differ from each other for the floor panels 1A and 1B in respect to shape, however, in accordance with the present invention in fact are compatibly coupleable. Herein, FIG. 15 shows the first pair of opposite edges 2A-3A of the first floor panel 1A, in a cross-section similar to that of FIG. 4. FIG. 16 shows the first pair of edges 2B-3B of the second floor panel 1B, in a cross-section similar to that of FIG. 8. FIG. 17 represents that the coupling part 6A is coupleable to the coupling part 7B and FIG. 18 represents that the coupling part 6B is coupleable to the coupling part 7A.

The floor panels 1A and 1B of the embodiment represented in FIGS. 15 to 18 preferably are also oblong. The first pair of edges of each of the floor panels in this case as well preferably is situated at the long sides thereof. At the short sides, compatible coupling parts are provided as well, for example, coupling parts analogous to those depicted in FIGS. 5 and 9.

It is noted that in general by "compatible coupling means" or "compatible coupling parts" has to be understood that such coupling parts or coupling means allow coupling the coupling parts to each other in such a manner that a vertical as well as a horizontal locking is obtained. However, this does not exclude that such vertical or horizontal locking can or cannot be performed with a play or pretension, in other words, press-fit, in vertical and/or horizontal direction. Also, it is perfectly possible that, when first floor panels are mutually coupled, or second floor panels are mutually coupled, there is no play or indeed there is play, whereas, when a first and a second floor panel are coupled to each other, vice versa there is play indeed or there is no play in vertical and/or horizontal direction.

It is clear that the aforementioned turning movement R not necessarily must consist of a circular movement. Also, it is clear that such turning movement, which herein above generally always is indicated by "R", can be different with the different floor panels to be coupled, by which is meant that the turning curves, although always indicated by "R", can deviate from each other.

It is clear that by a downward movement M normally a movement is meant wherein, seen in a cross section on the respective edges, thus, according to cross-sections such as, for example, represented in FIGS. 5, 9, 11 and 12, the projections of the upper sides in these cross-sectional planes remain parallel or substantially parallel to each other during the downward movement. However, the downward movement does not have to be perfectly vertical, as during the downward snapping-in a slight lateral shifting may occur when the respective coupling parts fit into each other in a self-searching manner.

It is also clear that coupling parts, which, as aforementioned, are configured such that the floor panels, by means of these coupling means, can be coupled to each other by means of a turning movement, can be realized in various forms. Preferably, however, as represented in the figures, to this aim use shall be made of a tongue and groove of the type wherein the groove 38A, 38B, respectively, is bordered by an upper lip and a lower lip, wherein the lower lip laterally reaches farther than the upper lip, and wherein the respective locking part 40A-40B is situated at least partially and preferably entirely in that portion of the lower lip which protrudes beyond the end of the upper lip.

It is noted that, when a first floor panel and a second floor panel are coupled to each other at their second pair of edges, the compatible vertical locking preferably is obtained at least via locking parts which belong to the aforementioned first contact zones C1A and C1B, in the example the locking parts 18A with 20B and/or 18B with 20A.

The present invention is in no way limited to the embodiments described as an example and represented in the figures; on the contrary, such "first" and "second" floor panels can be realized in various forms and dimensions without leaving the scope of the invention.

The invention claimed is:

1. A plurality of floor panels, consisting of a first series of floor panels including first floor panels, and a second series of floor panels including second floor panels, wherein the first floor panels have the following characteristics:

the floor panel comprises a first pair of opposite edges and a second pair of opposite edges;

the first pair of opposite edges comprises coupling parts arranged to allow two of such first floor panels to mutually couple to each other, wherein the coupling parts of the first pair of opposite edges show the following characteristics:

the coupling parts comprise a horizontally active locking system, arranged, in a coupled condition of two of such floor panels, to effect a locking in a plane of the floor panels and perpendicular to the respective edges;

the coupling parts comprise a vertically active locking system, arranged, in a coupled condition of two of such first floor panels, to effect a locking transverse to the plane of the floor panels;

the coupling parts are realized from a material of the first floor panel and the coupling parts are configured such that two of such first floor panels are arranged to couple to each other at the first pair of opposite edges by a turning movement;

the second pair of opposite edges comprises coupling parts at both edges arranged to allow two of such first floor panels mutually to be coupled to each other, wherein the coupling parts of the second pair of opposite edges show the following characteristics:

the coupling parts comprise a horizontally active locking system, which, in a coupled condition of two of such first floor panels, effects a locking in the plane of the first floor panels and perpendicular to the respective edges;

the coupling parts comprise a vertically active locking system, which, in a coupled condition of two of such first floor panels, effects a locking transverse to the plane of the first floor panels;

the coupling parts are realized from the material of the first floor panel;

wherein the horizontally active locking system of the second pair of edges is at least formed of an upward-directed lower hook-shaped part which is situated on one of said two edges, and a downward-directed upper hook-shaped part which is situated at the opposite edge, wherein the lower hook-shaped part consists of a lip with an upward-directed locking element, which, proximally thereto, defines a female part forming a recess, whereas the upper hook-shaped part consists of a lip with a downward-directed locking element which forms a male part;

wherein the coupling parts are configured such that two of such first floor panels are arranged to couple to each other at respective edges by means of a downward movement of the floor panel in respect to the second floor panel;

wherein the vertically active locking system comprises vertically active locking parts, which, by means of respective contact surfaces, define at least a first contact zone and a second contact zone which are situated on opposite sides of the male part and female part;

wherein the vertically active locking parts comprise a first locking part and a second locking part at the respective opposite sides of the male part, and a third locking part and a fourth locking part at the respective opposite sides of the female part;

wherein the first and third locking parts, in a coupled condition of two of such first floor panels, define the first contact zone, wherein the first and third locking parts have contact surfaces, which, in the coupled condition, define at least one inclined tangent line;

wherein the second and fourth locking parts, in the coupled condition of two of such first floor panels, define the second contact zone, wherein the second and fourth locking parts have contact surfaces, which, in the coupled condition, and define at least one inclined tangent line;

wherein the male part has a distal side and a proximal side, wherein the second locking part is situated at the distal side;

wherein the two tangent lines are upwardly inclined towards each other, and in respect to the recess of the female part inwardly, inclined and the tangent lines, upwardly and in respect to a vertical, are inclined in opposite directions; and wherein the second floor panels show the following characteristics:

the floor panel comprises a first pair of opposite edges and a second pair of opposite edges;

the first pair of opposite edges comprises coupling parts which allow that two of such floor panels mutually are arranged to couple to each other, wherein the coupling parts of the first pair of opposite edges show the following characteristics:

the coupling parts comprise a horizontally active locking system, which, in a coupled condition of two of such floor panels, effects a locking in a plane of the floor panels and perpendicular to the respective edges;

the coupling parts comprise a vertically active locking system, which, in a coupled condition of two of such floor panels, effects a locking transverse to the plane of the floor panels;

the coupling parts are realized from the material of the floor panel; and the coupling parts are configured such that two of such panels are arranged to couple to each other at these edges by means of a turning movement;

wherein the second pair of opposite edges comprises coupling parts at both edges, which allow that two of such second floor panels mutually are arranged to couple to each other, wherein the coupling parts of the second pair of opposite edges show the following characteristics:

wherein the coupling parts comprise a horizontally active locking system, which, in a coupled condition of two of such second floor panels, effects a locking in the plane of the second floor panels and perpendicular to the respective edges;

wherein the coupling parts comprise a vertically active locking system, which, in a coupled condition of two of such second floor panels, effects a locking transverse to the plane of the floor panels;

wherein the coupling parts are realized from the material of the second floor panel;

wherein the horizontally active locking system of the second pair of edges is at least formed of an upward-directed lower hook-shaped part which is situated at one of the two edges, and a downward-directed upper hook-shaped part which is situated at the opposite edge, wherein the lower hook-shaped part consists of a lip with an upward-directed locking element that proximally thereof defines a female part forming a recess, whereas the upper hook-shaped part consists of a lip with a downward-directed locking element which forms a male part;

wherein the coupling parts are configured such that two of such second floor panels are arranged to couple to each other at respective edges by means of a downward movement of the one second floor panel in respect to another second floor panel;

wherein the vertically active locking system comprises vertically active locking parts, which, by means of respective contact surfaces, define at least a first contact zone and a second contact zone;

wherein the male part has a distal side and a proximal side;

wherein the lower hook-shaped element has a distal end;

wherein the vertically active locking parts comprise a first locking part and a second locking part at the edge which is provided with the male part, and a third locking part and a fourth locking part at the edge which is provided with the female part;

wherein the first and third locking parts, in the coupled condition of two of such second floor panels, define the first contact zone, wherein the first locking part is situated at the proximal side of the male part, whereas the third locking part is situated at an opposed side of the female part of the second floor panel coupled thereto;

wherein the second and fourth locking parts, in the coupled condition of two of such second floor panels, define the second contact zone, wherein the fourth locking part is situated at the distal end of the lower hook-shaped element, whereas the second locking part is situated at the opposed side of the second floor panel coupled thereto;

wherein the coupling parts, of the first pair of edges of the first floor panels and the coupling parts, of the first pair of edges of the second floor panels, are compatible with each other, and wherein the coupling parts, of the second pair of edges of the first floor panels and the coupling parts, of the second pair of edges of the second floor panels are compatible with each other, such that, when one first floor panel and one second floor panel are coupled to each other, via edges of the first pair of edges, a horizontal and a vertical locking is maintained, and such that, when one first floor panel and one second floor panel are coupled to each other, via edges of the second pair of edges, a horizontal and a vertical locking is maintained.

2. The plurality of floor panels according to claim 1, wherein the first and second floor panels consist of oblong floor panels, wherein the first pair of opposite edges forms the long sides and the second pair of opposite edges forms the short sides.

3. The plurality of floor panels according to claim 1, wherein, when one first floor panel and one second floor panel are coupled to each other at the second pair of edges, the compatible vertical locking is obtained at least via locking parts which belong to the first contact zones.

4. A floor panel, configured for forming a plurality of floor panels according to claim 1, wherein the floor panel is a first floor panel;

wherein the first floor panel, at least on one or more edges is realized compatible with the second floor panels.

5. The floor panel according to claim 4, wherein the first floor panel is on all respective edges realized compatible with the second floor panels.

6. The floor panel, configured for forming a plurality of floor panels according to claim 1, wherein the floor panel is a second floor panel;

that the second floor panel, at least on one or more edges, is realized compatible with the floor panels.

7. A floor panel according to claim 6, wherein the second floor panel is on all respective edges realized compatible with the first floor panels.

8. A floor covering, wherein the floor covering comprises the plurality of floor panels as in claim 1, coupled to each other at the contacting edges.

9. A method of installing a floor covering as in claim 8, wherein the plurality of floor panels is used in installing the floor covering.

* * * * *